US005538456A

United States Patent [19]

Liu et al.

[11] Patent Number: 5,538,456

[45] Date of Patent: Jul. 23, 1996

[54] TOY WATER BOMB

[75] Inventors: Dexter C.-T. Liu, Portsmouth; David Weindel, East Greenwich, both of R.I.

[73] Assignee: LCD International, L.L.C., Newport, R.I.

[21] Appl. No.: 287,693

[22] Filed: Aug. 9, 1994

[51] Int. Cl.[6] ..... A63H 37/00

[52] U.S. Cl. ..... 446/473; 446/186; 446/222; 446/475; 273/58 H; 273/428; 273/423; 222/78

[58] Field of Search ..... 446/4, 176, 180, 446/186, 197, 220, 222, 224, 267, 473, 475; 434/11, 14, 15; 273/58 BA, 58 H, 418, 428, 420, 423; 102/488, 498, 529, 353–355; 222/78

[56] References Cited

U.S. PATENT DOCUMENTS

| | | | |
|---|---|---|---|
| D. 335,901 | 5/1993 | Gill, III | D21/84 |
| 1,920,257 | 8/1933 | Halland | 434/15 |
| 3,022,785 | 2/1962 | Crockford | 273/418 |
| 3,617,060 | 11/1971 | Iezzi | 273/418 |
| 3,878,639 | 4/1975 | Scheelar et al. | 46/1 R |
| 4,212,460 | 7/1980 | Kraft | 273/58 B |
| 4,319,426 | 3/1982 | Lee | 102/498 |
| 4,890,838 | 1/1990 | Rudell et al. | 273/138 R |
| 4,932,672 | 6/1990 | Tippmann | 273/428 |
| 4,944,521 | 7/1990 | Greeno | 102/498 |
| 4,991,847 | 2/1991 | Rudell et al. | 273/138 R |
| 5,018,449 | 5/1991 | Eidson, II | 102/498 |
| 5,240,450 | 8/1993 | Graham | 446/267 |
| 5,277,642 | 1/1994 | Dorta | 446/76 |
| 5,288,261 | 2/1994 | Spector | 446/267 |
| 5,354,225 | 10/1994 | Hix | 102/498 |

*Primary Examiner*—Robert A. Hafer
*Assistant Examiner*—Jeffrey D. Carlson
*Attorney, Agent, or Firm*—Panitch Schwarze Jacobs & Nadel

[57] ABSTRACT

A water toy has the shape of an aerial bomb or rocket with generally bulbous, resiliently flexible body and a removable tail member with fins, The water toy includes a resilient shell having a mouth and an internal pointed member facing the mouth. A balloon has a mouth with a lip that fits around and engages the mouth of the shell with the balloon body in the shell. The two mouths are sufficiently large to receive ice cubes. A cover member is fitted over and releasably engages the mouth of the shell sufficiently snugly to seal the mouth of the balloon on the mouth of the shell. The cover member has a recess with a one-way check valve to permit the balloon, which is sealed between the cover member and shell, to be filled with water. The tail member is received in the recess and releasably engages the cover member. Dispersion passageways extend from the inner through the outer surfaces of the shell. When the toy strikes an object with sufficient velocity after being thrown or dropped, the nose and pointed member move inward while the balloon stretches forward towards the nose, due to continuing momentum of its water and ice, until the balloon bursts on the pointed end. The released iced water surges outwardly from the shell through the passageways.

19 Claims, 5 Drawing Sheets

TOY WATER BOMB

FIELD OF THE INVENTION

This invention relates to a liquid-filled game toy. More particularly, this invention relates to a game toy simulating a bomb and carrying water as its payload.

BACKGROUND OF THE INVENTION

Hand thrown toys that simulate explosive devices and release water upon impact are well known, and some of which are disclosed in U.S. Pat. No. 3,878,639 of Scheelar et al; U.S. Pat. No. 4,212,460 of Kraft; U.S. Pat. No. 4,890,838 of Rudell et al; U.S. Pat. No. 4,932,672 of Tippmann; and U.S. Pat. No. 5,240,450 of Graham. For all such toys, it is desired that the toys be easily handled and properly weighted or shaped so that the toys may be easily thrown and land upon their bottom section upon impact so as to properly release the confined liquid. Further, it is desired that the liquid, such as water, being confined within the toy, be easily replenished so that the toy may be quickly made available for reuse. Moreover, it is desired that all of the toys be inexpensive to manufacture and yet practical and efficient in their use. Whereas each of the designs of the known toys stress some of the mentioned desired advantages, none of the toys possesses all of the desired advantages. For example, the toy of U.S. Pat. No. 3,878,639 is filled with a pressurized liquid which limits the ease of its reusability. Similarly, the toy of U.S. Pat. No. 4,212,460 is easily filled with water, but its side panels must be particularly and critically designed so as to confine the contained water therein and which critical design has attendant drawbacks with regard to its manufacture. Further, the toy of U.S. Pat. No. 4,890,838 carries a balloon, but also includes a timer mechanism for releasing the contained water therein and which timer increases the cost of manufacture. Furthermore, the toy of U.S. Pat. No. 4,932,672 requires the placement and manipulation of a pin which somewhat hinders the quickness to restore it in a reusable state. Similarly, the toy of U.S. Pat. No. 5,240,450 also requires the placement and manipulation of a pin therein before the toy is in a reusable condition.

The prior art indicated by the aforementioned references, describing water-filled toys, seems to be limited in that none of the disclosed devices has all of the previously desired advantages. More particularly, none of the disclosed references provides one water-filled toy that is easily handled, conveniently replenished of its liquid source, quickly and readily made available for reuse, and inexpensively manufactured yet highly efficient to cause dispersal of water upon impact.

SUMMARY OF THE INVENTION

It is an object of the present invention to provide a water filled toy that is easily handled, conveniently replenished of its water source, quickly and readily made available for reuse, and inexpensively manufactured yet highly efficient in its intended use.

It is a further object of the present invention to provide a toy having water that is easily placed into a container that bursts upon impact, thereby, causing the water to splash out.

Further, it is an object of the present invention to provide a toy having water which is made cold by the insertion of ice cubes so that when the released water splashes on an object, such as a person, it has somewhat soothing benefits, especially on a hot summer day.

Further still, it is an object of the present invention to provide for a water-filled toy that is constructed so as to be snapped together allowing the toy to be easily reassembled and made available for reuse in a relatively rapid manner.

It is another object of the present invention to provide a rupturable container, in the form of an elastic balloon, having a mouth with a lip that is sufficiently large so that ice cubes may be easily inserted into the container. The wide mouth also accommodates a spout of a conventional water faucet allowing the container to be quickly and conveniently filled.

Each of these and other objects are met by at least the preferred embodiment subsequently described. Non-preferred embodiments of the invention may meet only some of these objects.

In one aspect, the invention is an impact actuated water toy which comprises a flexibly resilient shell, a pliant rupturable container, and a cover member. The shell has opposing inner and outer surfaces and a plurality of dispersion passageways extending from the inner surface through the outer surface and has a mouth on one end and a rupturing member on the other end. The rupturing member has a pointed end that extends toward the mouth. The rupturable container has a mouth with a lip sized to fit around and over the shell mouth. The cover member releasably engages with the shell mouth and fits the shell mouth sufficiently closely to seal the container mouth fitted over the shell mouth.

In another aspect, the invention is an impact actuated water toy comprising a flexibly resilient shell having opposing outer and inner surfaces with a plurality of dispersion passageways extending from said inner surface through said outer surface and having a mouth on one end and a rupturing member on the other end, said rupturing member having a pointed end that extends toward said mouth; a cover member fitted over and releasably engaged with said shell mouth covering said shell mouth; and a rupturable elastic container within said shell secured to at least one of said shell and said cover member and facing said pointed end of said rupturing member.

In yet another aspect, the invention is an improvement in a water toy including a hollow body surrounding an interior chamber with a plurality of dispersion passageways extending from the chamber through the body, a mouth on the body providing access to the chamber and a member having a pointed end at least exposable in the chamber, the improvement comprising an elastic balloon having a mouth with a lip, the mouth and lip being sufficiently wide and elastic to be fitted without breakage over the mouth of the body with a remainder of the balloon located in the chamber and the mouth of the fitted balloon being about one-and-one-half inches or more in width to accept at least ordinary sized ice cubes in the fitted balloon.

BRIEF DESCRIPTION OF THE DRAWINGS

The foregoing "Summary of the Invention" and the following detailed description of preferred embodiments will be understood when read in conjunction with the appended drawings. Although preferred embodiments are shown in the drawings, it should be understood that the invention is not limited to the precise arrangements and instrumentalities shown in the drawings, which are all diagrammatic.

DETAILED DESCRIPTION OF PREFERRED EMBODIMENTS

Figure 1:
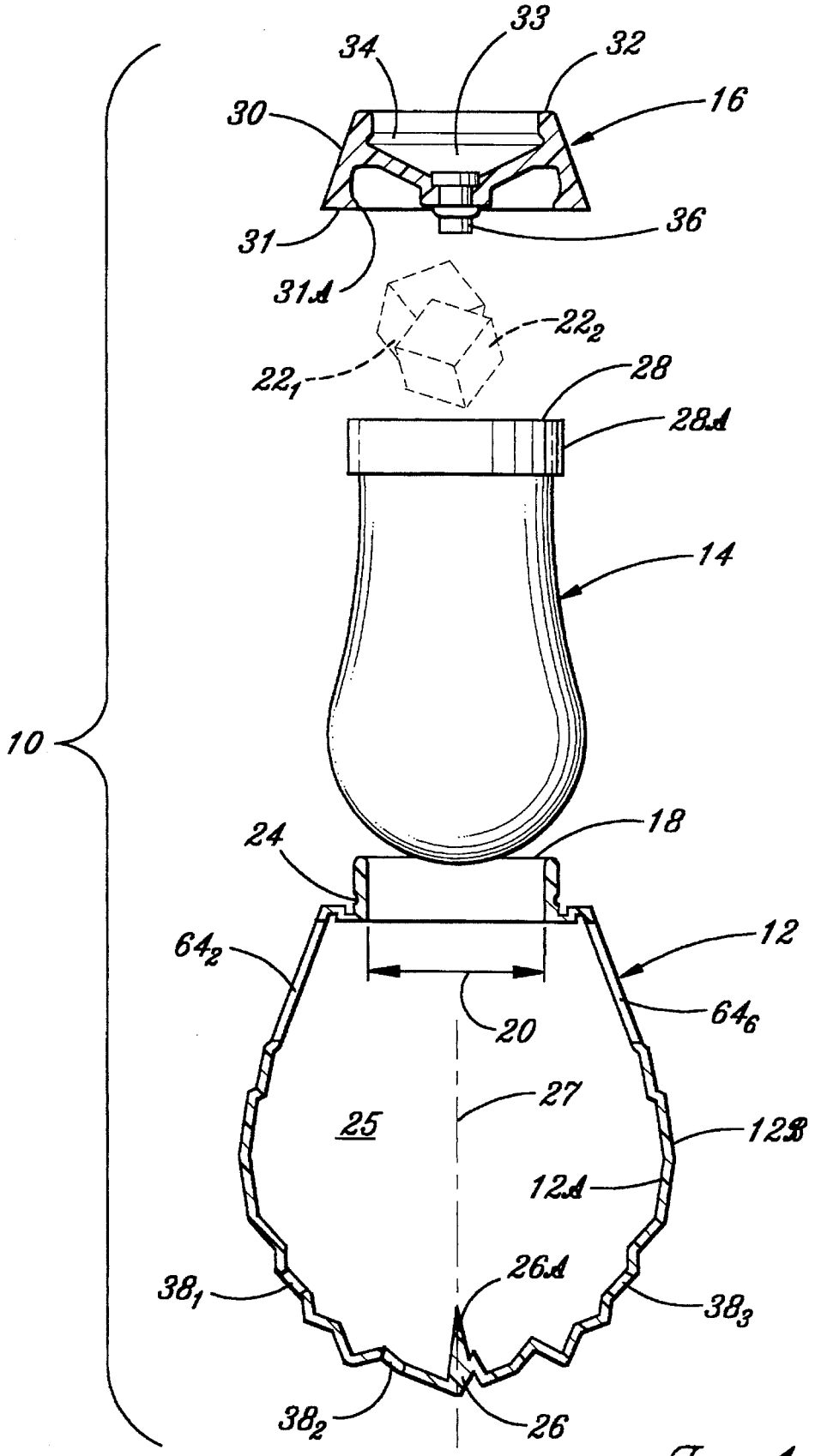
FIG. 1 is an exploded view illustrating part of a preferred embodiment of the water toy of the present invention.

In the drawings, like numbers are employed for the indication of like elements.

Referring to the drawings, in particular to FIG. 1, there is shown an exploded view of a preferred water toy 10 comprising a flexibly resilient shell 12, a pliant rupturable container 14, such as a balloon, and a cover member 16. The water toy 10 has the shape of an aerial bomb or rocket that is dimensioned so as to land or contact the front or nose of shell 12 (bottom portion as viewed in FIG. 1), when impacting the ground or an object. The water toy 10 carries a fluid, such as water, and solids, such as one or more ice cubes, in its rupturable container as its payload and causes at least the fluid portion of its payload to be dispersed, in a splashing manner, upon impact.

The resilient shell 12 defines at least part of an overall hollow body surrounding an interior chamber 25. The resilient shell 12 has a generally bulbous shape and may be molded or otherwise formed of a relatively resiliently flexible plastic material such as, for example, clear or translucent polyvinylchloride (PVC), polyethylene or acrylonitrile butadiene styrene (ABS). The resilient shell 12 has a mouth 18 with an opening 20 (preferably circular) of predetermined size sufficiently wide to accept at least ordinary sized ice cubes indicated in FIG. 1 by reference numbers $\mathbf{22}_1$ and $\mathbf{22}_2$. Mouth 18 is at least one inch wide to accommodate at least the smallest uniformly sized ice cubes, desirably at least about one-and-one-half or more inches wide to accommodate conventional sized cubes and preferably about two or more inches wide to easily accommodate virtually all uniformly sized ice cubes. The mouth 18 further has a circumferential groove 24 around its lower exterior portion. The shell 12 further includes a rupturing member 26 which extends inward toward the mouth 18 and which has a pointed end 26A that is exposed, as shown in FIG. 1, within the interior chamber 25 of shell 12. The member 26 is preferably located along the centerline 27 of the shell 12.

The balloon 14 preferably comprises an elastic balloon having a mouth 28 with a lip 28A sufficiently wide and elastic to permit the lip 28A to be easily stretched or otherwise fitted without breakage by a child over the preferably circular mouth 18 of the shell 12 and to fit around and preferably engage shell mouth 18. When the lip 28A is mounted to the shell mouth in this manner, the remainder of the balloon 14 is located in the interior chamber 25 of shell 12 so as to permit filling of the balloon 14 with ice cubes and with water from a conventional water faucet, in a preferred manner to be further described with reference to FIG. 3.

The cover member 16 preferably is formed of nonporous polymer materials and preferably has flexibly resilient side walls 30. The cover member 16, as described with reference to FIG. 3, has an inner side 31 (as viewed in FIG. 1) that is sized to fit over the mouth of shell 12 and mouth 28 of the balloon 14. An inner protrusion 31A, which may be circular, square or some other shape, releasably engages circumferential groove 24 and fits the shell mouth 18 sufficiently closely to retain the balloon 14 on the shell mouth 18 and to seal the mouth 28 of the balloon 14 while it is fitted over the mouth 18 of the shell. The balloon 14 is thus secured to the shell 12 facing the pointed end 26A of member 26. An outer side 32 of cover member 16 is used to direct water into the balloon 14 and to receive a tail member 46 to be described with reference to FIG. 3. The outer side 32 of cover member 16 has an exposed recess 33, preferably funnel shaped, and an inner circumferential groove 34 located at the outer end of the recess 33. A one-way check valve 36 is provided at the base of the recess 33 and is oriented to allow the passage of fluid through cover member 16 into the balloon 14, which has a major portion thereof positioned in the interior chamber 25 of the shell 12. The shell 12 may be further described with reference to FIG. 2.

Figure 2:
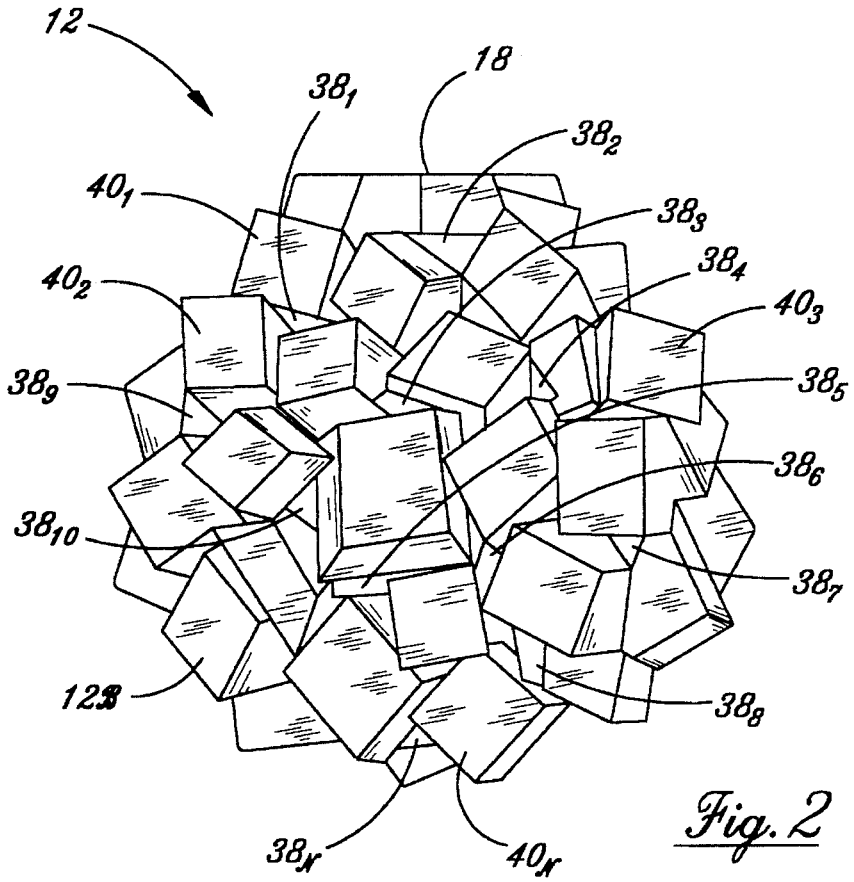
FIG. 2 is a front view illustrating further details of the resilient shell of FIG. 1.

FIG. 2 is a front view illustrating the nose or forward end of the resilient shell 12 as having a plurality of dispersion passageways $\mathbf{38}_1$, $\mathbf{38}_2$ . . . $\mathbf{38}_N$ each of which extends from the inner surface 12A of the shell 12 (see FIG. 1) to its outer surface 12B and thus from chamber 25 through the hollow body defined at least in part by shell 12. The dispersion passageways $\mathbf{38}_1$ . . . $\mathbf{38}_N$ are shown in FIG. 2, as well as in FIGS. 1, 5 and 6, in a random manner and as clustered between raised plateau members $\mathbf{40}_1$, $\mathbf{40}_2$, $\mathbf{40}_3$, . . . $\mathbf{40}_N$, which extend out of the outer surface of shell 12. The members $\mathbf{40}_1$, $\mathbf{40}_2$, $\mathbf{40}_3$ . . . $\mathbf{40}_N$ have the shape of raised plateaus, some of which are peaked, e.g., $\mathbf{40}_3$, and some of which have a relatively flat surface, e.g., $\mathbf{40}_2$, giving the overall appearance of a cluster of ice cubes.

Figure 3:
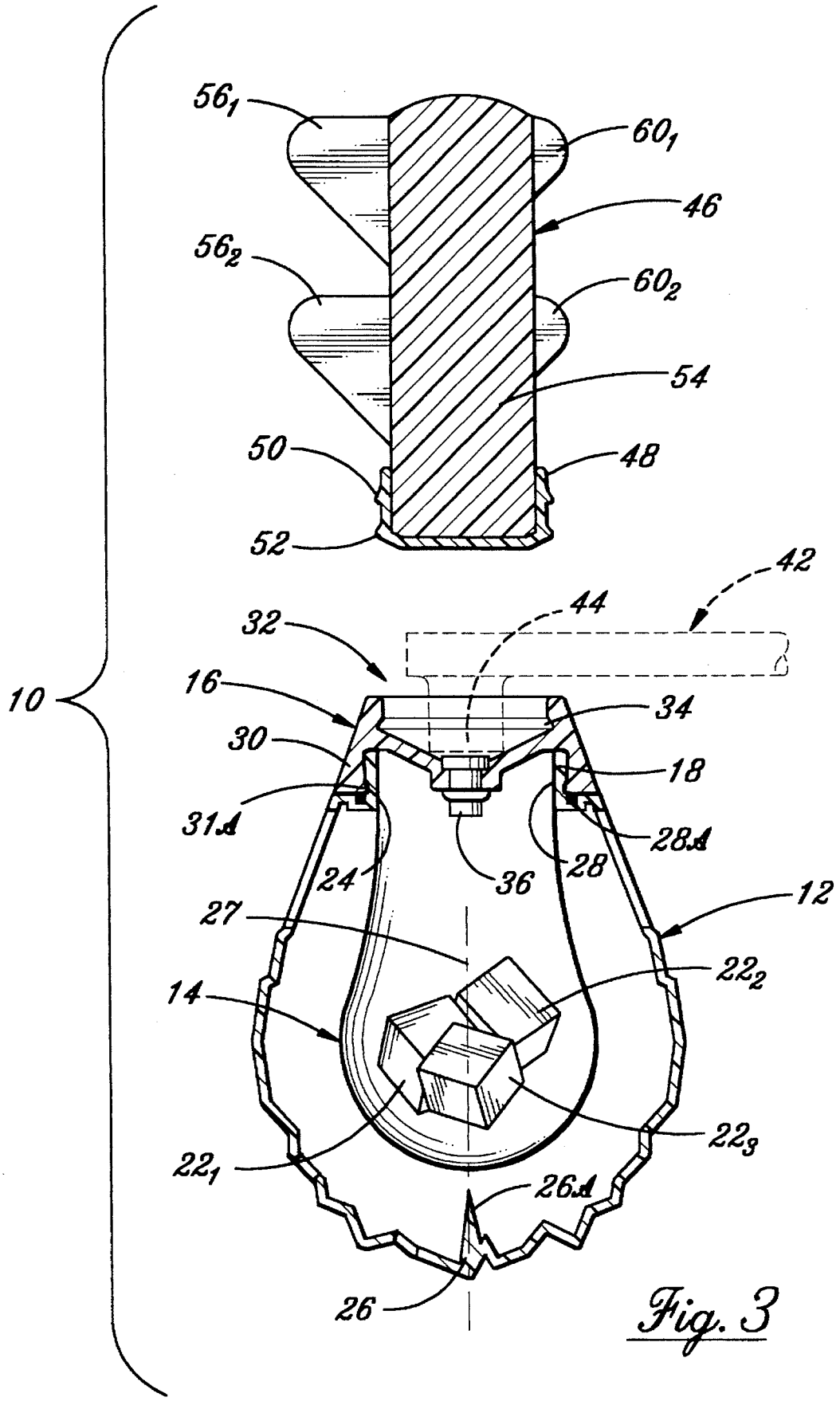
FIG. 3 illustrates, in part, the ease and convenience of filling the water toy of the present invention with tap water.

FIG. 3 illustrates that the mouth 18 of shell 12 is engaged by the mouth 28 of the balloon 14. In particular, the lip 28A of balloon 14 fits around and preferably frictionally engages the mouth 18. Further, FIG. 3 illustrates that the mouth 18 is engaged by the side walls 30 of the cover member 16. More particularly, the circumferential protrusion 31A of the flexibly resilient side wall 30 of cover member 16 fits into and engages the circumference groove 24 of the lower portion of the outer surface of shell mouth 18. The inner side 31 of cover member 16 is preferably formed to fit sufficiently closely against the mouth 18 of shell 12 when protrusion 31A engages groove 24 that the cover member 16 seals the mouth 28 (not shown in FIG. 3) of the balloon 14 fitted over the mouth 18 of the shell 12. The protrusion 31A and the groove 24 are dimensioned so as to provide a snap-like interference and frictional engagement therebetween so as to allow quick connection/disconnection between the shell 12 and the cover member 16, which is desired for the rapid replacement of a burst balloon 14.

As further seen in FIG. 3, ice cubes $\mathbf{22}_1$, $\mathbf{22}_2$, and $\mathbf{22}_3$ preferably are added to the balloon 14 before cover member 16 is snapped onto the mouths of the balloon 14 and shell 12. The balloon 14 is then filled with water or other fluid through cover member 16. Water enters the balloon 14 by way of one-way check valve 36 of cover member 16, and may be drawn from a conventional faucet 42 having a spout 44 (both shown in phantom). The recess 33 of the cover member 16 has a diameter at its central portion that is wide enough to accommodate the insertion of the spout 44 therein, as shown in FIG. 3, so that the spout 44 may be positioned in the recess proximate the one-way check valve 36, thereby, allowing for the convenient filling of the balloon 14, after its mouth 28 has been stretched onto mouth 18, with water from the conventional faucet 42. The recess desirably has a diameter of at least about one inch to accommodate conventional, seven-eighths inch diameter kitchen faucet spouts and preferably about one-and-one-half inches or more to accommodate even larger spouts. The conical shape of the recess 33 allows a contact seal to be easily formed between the cover member 16 and spout 44, merely by pressing the center of the recess 33 against the discharging face of the spout 44.

As still further seen in FIG. 3, the water toy 10 further preferably includes a tail member 46 preferably shaped, such as by the provision of a collar portion 48, so as to releasably matingly engage with the recess 33 on the outer side 32 of the cover member 16. More particularly, the collar portion 48 has circumferential protrusions 50 and 52 that engage between them the distal top region of the cover member 16, as viewed in FIG. 3, while protrusion 52 also engages the circumferential groove 34. The tail member 46 may comprise a foamed plastic material such as a urethane foam, and includes a shaft 54 from which extends a plurality of directional fins. The directional fins are arranged in pairs, with one such pair being shown as $\mathbf{56}_1$ and $\mathbf{56}_2$. Additional preferred pairs of directional fins $\mathbf{58}_1$ and $\mathbf{58}_2$, and $\mathbf{60}_1$ and $\mathbf{60}_2$ may be further described with reference to FIG. 5.

Figure 4:
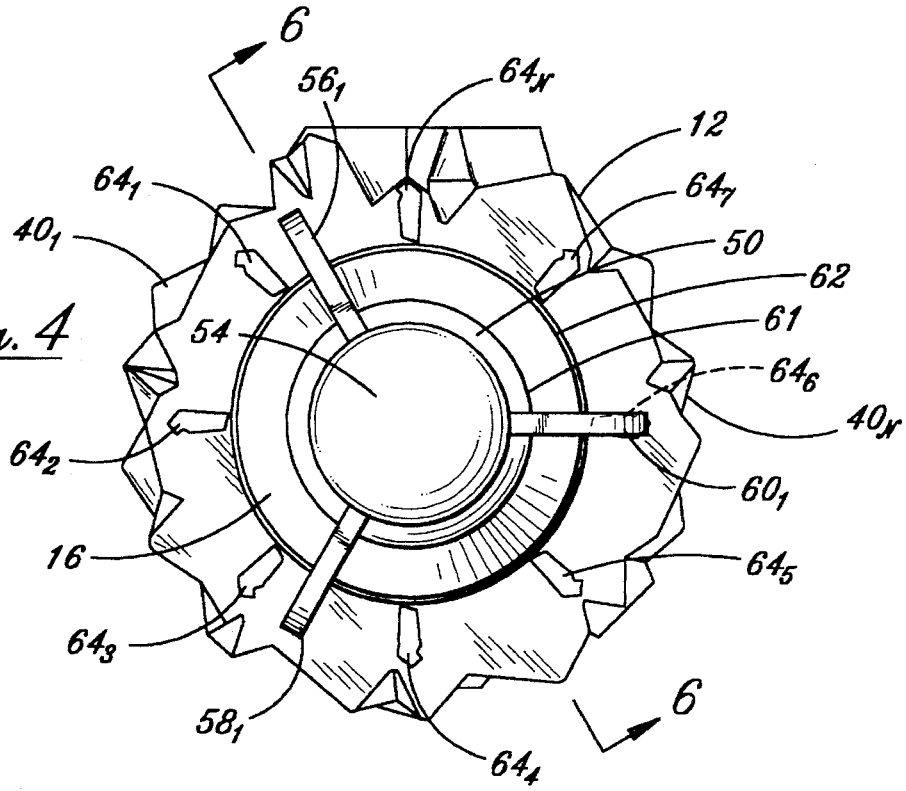
FIG. 4 is an end view, showing further details of the water toy of the present invention.

FIG. 4 is an end view of water toy 10 and illustrates the pairs of directional fins 56, 58, and 60, but only shows one fin $\mathbf{56}_1$, $\mathbf{58}_2$, and $\mathbf{60}_1$ of each pair. The pairs of fins 56, 58 and 60 are preferably spaced apart from each other, about the circumference of shaft 54, by about 120 degrees. Further, FIG. 4 illustrates the protrusion 50 of tail member 46 and a circumferential groove 61 formed at the junction of the protrusion 50 and the cover member 16. Further, FIG. 4 illustrates additional passageways used for the dispersion of water and indicated as $\mathbf{64}_1$, $\mathbf{64}_2$, $\mathbf{64}_3$, $\mathbf{64}_4$, $\mathbf{64}_5$, $\mathbf{64}_6$ (partially shown), $\mathbf{64}_7$, and $\mathbf{64}_N$, which have an irregular shape that assists in creating a splashing action when the water is emitted therefrom. The dispersion passageways $\mathbf{64}_1 \ldots \mathbf{64}_N$ and the circumferential groove 62 may be further described with reference to FIGS. 4 and 5.

Figure 5:
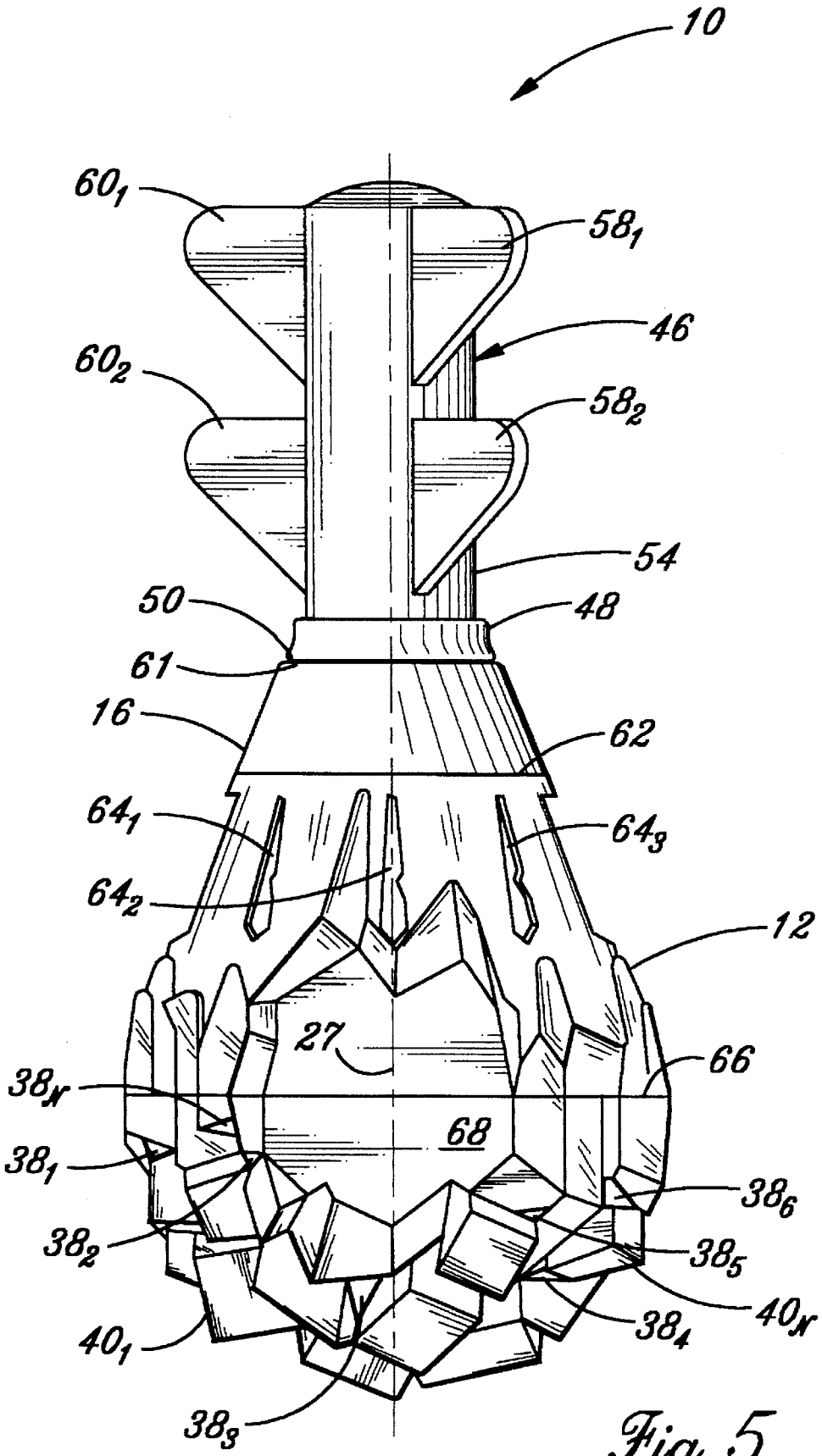
FIG. 5 is an elevational view illustrating the assembled water toy as having a tail member with directional fins that guide the toy in flight.

As seen in FIGS. 4 and 5, a circumferential groove 61 defines the exposed portion of the mating joint of the tail member 46 with the outer side 32 of cover member 16 while groove 62 defines the exposed portion of the mating joint of the inner side 31 of cover member 16 to the resilient shell 12. The passageways $\mathbf{64}_1$, $\mathbf{64}_2$, and $\mathbf{64}_3$ (as well as the passageways $\mathbf{64}_4 \ldots \mathbf{64}_N$ not shown) are located directly below the groove 62. Furthermore, the shell 12 may have an additional circumferential groove 66 at its central region or widest region. Groove 66 intersects a relatively flat surface 68, which is provided to receive a label or other marking. If desired, the shell 12 may comprise two molded thermoplastic material pieces provided with appropriately complementary channels or other mating structures so that the shell 12 may be broken apart or connected, in a snap-lock manner, at the circumferential groove 66. FIG. 5 further illustrates the dispersion passageways $\mathbf{38}_1 \ldots \mathbf{38}_N$ and the raised plateau members $\mathbf{40}_1 \ldots \mathbf{40}_N$ already described with reference to FIG. 2.

As is further seen in FIG. 5, the tail member 46 has its collar portion 48 engaged to the cover member 16 with its fins 56, 58, 60 extending out of shaft 54 and arranged in pairs such as $\mathbf{60}_1$ and $\mathbf{60}_2$ and $\mathbf{58}_1$ and $\mathbf{58}_2$. The fins $\mathbf{56}_1 \ldots \mathbf{60}_2$, assist in directing or guiding the water toy 10 in flight so as to assist in the water toy 10 falling and impacting upon the forward or nose section of its bulbous shell 12 (bottom in FIGS. 1, 3, 5 and 6). The cooperation of shell 12 with the other components of the water toy 10 may be further described with reference to FIG. 6, which is a view taken along line 6—6 of FIG. 4.

Figure 6:
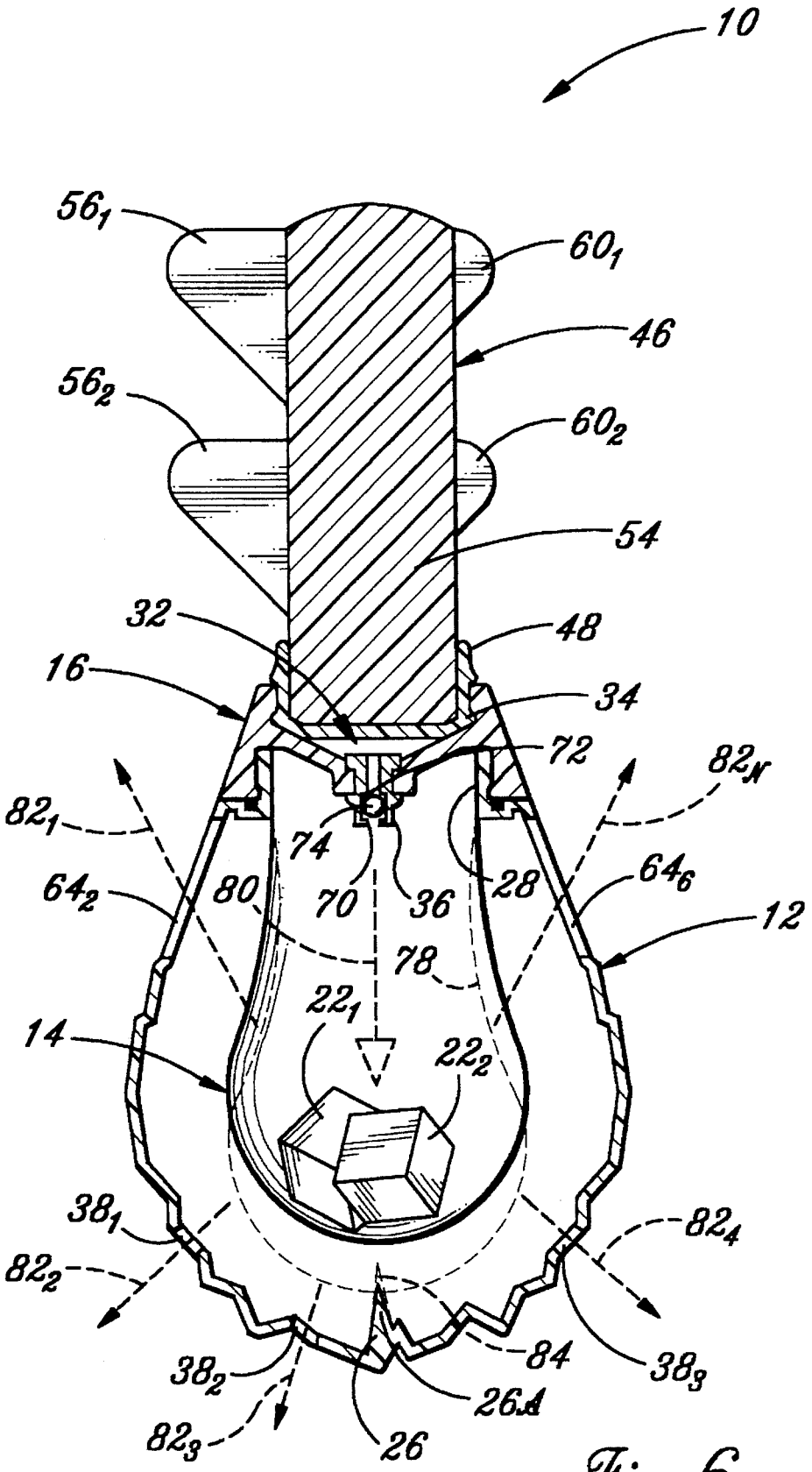
FIG. 6 is a sectioned elevational view, taken along lines 6—6 of FIG. 4, generally illustrating the bursting operation of the balloon on the water toy and the release of the confined water.

As previously discussed with reference to FIG. 3, the water is directed into the balloon 14 by way of the recess 33 of cover member 16 and one-way valve 36. As seen in FIG. 6, the one-way valve 36 has a bottom chamber with a exit portion 70 (serving as an exit portion) having rounded corners and grooves (or spaced lands) and an entrance portion 72 having sharp corners without grooves (serving as an entrance portion). The valve 36 preferably further comprises a ball 74 having a diameter which allows the water to pass by the ball 74 and through the grooves (or between the lands) and to find its way out of the exit portion 70, but not to pass by the ball. 74 so as to prevent any water from finding its way out of entrance portion 72 after filling. Thus, the one-way valve 36 is oriented to allow passage of the water into the balloon 14, but not allow any of the water within the balloon 14 to find its way out through the one-way valve 36.

As further seen in FIG. 6, the balloon 14 has an "at rest" position, indicated in solid at 76, and a dynamic "in motion" position, indicated in phantom at 78. The dynamic position is reached when the nose of the shell 12 strikes the ground or other object after being thrown. Inertia of the water or other matter in the balloon 14 continues its motion in the direction of arrow 80 (in phantom) stretching the balloon, extending it towards the nose end of the shell and pointed end 26A of member 26 until ruptured by contact with pointed end 26A. Water released from the balloon 14 has dispersion paths, indicated by directional arrows $\mathbf{82}_1$, $\mathbf{82}_2$, $\mathbf{82}_3$, $\mathbf{82}_4 \ldots \mathbf{82}_N$ that respectively exit passageways $\mathbf{64}_2$, $\mathbf{38}_1$, $\mathbf{38}_2$. $\mathbf{38}_3 \ldots \mathbf{64}_6$. Still further, the member 26 and, in particular, the pointed end 26A of member 26 is moved to an inward position 84 (indicated in phantom) by the nose of the water toy 10 impacting the ground or an object with sufficient velocity.

OPERATION OF THE WATER TOY

In operation, when the water toy 10 is thrown in the air or dropped from a height, the directional fins $\mathbf{56}_1 \ldots \mathbf{60}_2$, the bulbous shape of the shell 12, and the weight of the water cause the water toy 10 to fall downward and impact on the nose end of shell 12. The sudden impact of the water toy 10 causes the balloon 14 to move rapidly in an axial direction so that it becomes distended with its surfaces somewhat stretched in a taut condition. The distended-taut balloon 14 intercepts the pointed end 26A of the member 26, which is moving inwardly as shown by position 84, because of the impact of water toy 10. A sufficiently severe collision of the oppositely moving elements will cause the balloon 14 to burst. Momentum causes the released fluid to be propelled outward, as indicated by directional arrows $\mathbf{82}_1 \ldots \mathbf{82}_N$ so that the water finds its way out of the confines of shell 12 through passageways $\mathbf{38}, \ldots \mathbf{38}_N$ and $\mathbf{64}, \ldots \mathbf{64}_N$ and onto the surrounding objects in a splashing manner. Furthermore, the ice cubes chill the contained fluid and when such fluid is dispersed on surrounding objects, for example, an unsuspecting person, the cold fluid provides an invigorating chill, which is favorable, especially on a hot summer day.

It should now be appreciated that the practice of the present invention provides for a water toy that allows for the bursting of a balloon preferably in a relatively violent manner within the shell upon impact so that the contained fluid, preferably cold water, may be splashed onto surrounding objects.

Further, it should be appreciated that the practice of the present invention provides for a water toy that is easily assembled in a snap-type manner, accommodates an easily attachable elastic balloon, and has provisions that allow for the water to be easily placed into the balloon.

While a preferred embodiment of the present invention has been disclosed and modifications thereof suggested, it will be recognized by those skilled in the art that still other changes could be made to the above-identified embodiments of the invention without departing from the broader concepts thereof. For example and without limitation, the balloon and cover member might be configured to permit the balloon to be secured to the cover member, which would then be secured to the mouth of the shell. Cover member with valve 36 might be eliminated and the tail member 46 designed to sealably releasably engage directly with the mouth of the shell 12. Less desirably, a solid plug might be substituted for cover member 16 with its valve 36. Also, less desirably, a water filled balloon might be located within the interior chamber 25, secured in some way to either the shell or a cover member fitting over the shell mouth. For example, the compressed mouth of the balloon could be inserted into a slot extending axially from the shell mouth towards the nose or into a slot on the cover member extending axially away from the shell nose, which slot would further compress and seal the balloon mouth, or the open mouth of the balloon 14 could be pinched between the mouth of the shell 12 and a cover member releasably securing with the shell mouth. It should be understood, therefore, that the invention is not limited to the particular preferred embodiment disclosed and is entitled to cover the modifications which are within the scope and spirit of the invention, as defined by the appended claims.

What is claimed is:

1. An impact actuated water toy comprising:

(a) a flexibly resilient shell having opposing inner and outer surfaces with a plurality of dispersion passageways extending from said inner surface through said outer surface and having a mouth on one end and a rupturing member on the other end, said rupturing member having a pointed end that extends toward said mouth;

(b) a pliant rupturable container having a mouth with a lip fitted around and over said shell mouth; and (c) a cover member releasably engaged with said shell mouth and fitted sufficiently closely to the shell mouth to seal said container mouth fitted over said shell mouth.

2. The impact actuated water toy according to claim 1, wherein said mouth of said shell has a predetermined size sufficiently wide to accept at least ordinary sized ice cubes.

3. The impact actuated water toy according to claim 1, wherein said cover member includes a one-way valve oriented to allow passage of fluid into the rupturable container.

4. The impact actuated water toy according to claim 1, wherein the shell is formed with raised plateaus and wherein said plurality of dispersion passageways are clustered between the raised plateaus some of which are peaked and some of which have a relatively flat surface.

5. The impact actuated water toy according to claim 1, wherein said shell comprises two molded thermoplastic material pieces joined together.

6. The impact actuated water toy according to claim 1, wherein said shell has a generally bulbous shape.

7. The impact actuated water toy according to claim 1, wherein said container comprises an elastic balloon.

8. The impact actuated water toy according to claim 7, wherein the elastic balloon has a mouth sufficiently larvae and elastic to enable the mouth to be fitted without breakage over a tubular mouth at least one-and-one-half inches in diameter.

9. The impact actuated water toy according to claim 1 further comprising a tail member having a shaft with at least two directional fins.

10. The impact actuated water toy according to claim 9, wherein said tail member comprises foamed plastic material.

11. The impact actuated water toy according to claim 9, wherein the cover member has an outer side with an exposed recess and wherein an end of the tail member is shaped to releasably matingly engage with the cover member recess.

12. The impact actuated water toy according to claim 1, wherein said cover member has an outer side with a funnel shaped recess of a predetermined diameter sufficiently larvae so as to accommodate a spout end of a conventional water faucet.

13. The impact actuated water toy according to claim 12, wherein the predetermined diameter is about one inch or more.

14. The impact actuated water toy according to claim 3, wherein said fluid is water.

15. The impact actuated water toy according to claim 1 wherein said mouth of said shell is at least one-and-one-half inches wide.

16. In a water toy including a hollow body surrounding an interior chamber with a plurality of dispersion passageways extending from the chamber through the body, a mouth on the body providing access to the chamber and a member having a pointed end in the chamber, the improvement comprising an elastic balloon having a mouth with a lip, the mouth and lip being sufficiently wide and elastic to be fitted without breakage over the mouth of the body with a remainder of the balloon located in the chamber and the mouth of the fitted balloon being about one-and-one-half inches or more in width to accept at least ordinary sized ice cubes in the fitted balloon.

17. An impact actuated water toy comprising:

(a) a flexibly resilient shell having opposing inner and outer surfaces surrounding a hollow interior with a plurality of dispersion passageways extending from said hollow interior and inner surface through said outer surface, said shell having at least one flexibly resilient, bulbous end and including an internal elastic balloon rupturing member, the shell further including a mouth sufficiently large to receive an elastic balloon and the hollow interior of the shell being sufficiently large to contain an elastic balloon inflated with water; and (b) a tail member coupled with the shell at an end opposite the at least one flexibly resilient bulbous end of the shell, the tail member including a shaft extending away from the shell with a plurality of directional fins.

18. The impact actuated water toy according to claim 17 further comprising a cover member engaged with the mouth and engaged with the tail member so as to couple the tail member with the shell.

19. The impact actuated water toy according to claim 17 further comprising a water filled elastic balloon within the hollow interior of the shell, one end of the balloon being secured with the hollow shell.

* * * * *